United States Patent [19]

Endo

[11] 4,369,758

[45] Jan. 25, 1983

[54] PLASMA IGNITION SYSTEM

[75] Inventor: Hiroshi Endo, Yokosuka, Japan

[73] Assignee: Nissan Motor Company, Limited, Kanagawa, Japan

[21] Appl. No.: 303,024

[22] Filed: Sep. 17, 1981

[30] Foreign Application Priority Data

Sep. 18, 1980 [JP] Japan ..... 55-128596

[51] Int. Cl.[3] ..... F02P 1/00

[52] U.S. Cl. ..... 123/620; 123/596; 123/605; 123/606; 123/633; 123/634; 123/640; 123/643; 123/653

[58] Field of Search ..... 123/620, 596, 605, 606, 123/640, 653

[56] References Cited

U.S. PATENT DOCUMENTS

| | | | |
|---|---|---|---|
| 3,788,293 | 1/1974 | Anderson | 123/620 |
| 3,835,830 | 9/1974 | Shepherd | 123/620 |
| 3,906,919 | 9/1975 | Asik | 123/596 |
| 4,027,198 | 5/1977 | Linkroum | 123/596 |
| 4,317,068 | 2/1982 | Ward | 123/596 |

*Primary Examiner*—Ronald B. Cox

*Attorney, Agent, or Firm*—Lowe, King, Price & Becker

[57] ABSTRACT

A plasma ignition system for an internal combustion engine which can prevent irregular ignition when the insulation between the electrodes of the spark plug deteriorates due to carbon on the electrodes, and further can prevent electrical noise from being emitted. The system according to the present invention comprises a plasma ignition energy storing condenser, a plurality of switching units, and boosting transformers one each for each of the engine cylinders. In this system, a high tension is generated at the secondary coil of the boosting transformer to generate a spark between the electrodes of the plug and subsequently a large current is passed through the electrodes by the remaining energy stored in the condenser.

16 Claims, 14 Drawing Figures

PLASMA IGNITION SYSTEM

BACKGROUND OF THE INVENTION

1. Field of the Invention

The present invention relates generally to a plasma ignition system, and more particularly to a configuration of the plasma ignition system in which the single condenser storing the high ignition energy for each cylinder is connected to the output terminal of a DC—DC converter in order to perform plasma ignition by applying the current discharged from the condenser to the space between the electrodes of the respective spark plugs through respective boosting transformers when the respective switching units are turned on at the predetermined ignition times.

2. Description of the Prior Art

The plasma ignition system has been developed as a means of obtaining reliable ignition and for improving the reliability of fuel combustion even under engine operating conditions such that combustion is liable to be unstable when the engine is operated within a light-load region or when the mixture of air and fuel is weak.

In prior-art plasma ignition systems, a current flowing from a battery to the primary winding of an ignition coil is turned on or off by a contact point actuated according to the crankshaft revolution in order to generate high tension pulse signals in the secondary winding of the coil. These high voltage pulses are sent to the distributor through a diode and are next applied, in order, to the respective spark plugs through the respective high-tension cables. Accordingly, a spark is generated between the electrodes of the spark plug, and subsequently a high-energy electric charge of a relatively low voltage is passed from a plasma ignition power supply unit between the electrodes for a short period of time to generate a plasma.

In the prior-art plasma ignition system, however, since the output voltage from the plasma ignition power supply unit is simultaneously applied to all the spark plugs, an unwanted discharge can be generated between the electrodes at times other than the desired ignition times, thus resulting in the problem of irregular discharge.

Further, a large amount of power is consumed within the diode.

Furthermore, in the prior-art plasma ignition system, since the high tension cables are connected between the spark plug and the power supply unit, an impulsive current flows through the cables, thus resulting in another problem such that strong wide-band electrical noise is generated from the high tension cables.

A more detailed description of the prior-art plasma ignition system will be made under DETAILED DESCRIPTION OF THE PREFERRED EMBODIMENT with reference to the attached drawings.

SUMMARY OF THE INVENTION

With these problems in mind therefore, it is the primary object of the present invention is to provide a plasma ignition system which can reliably prevent irregular discharge between the electrodes, eliminate the need of a high voltage resistant diode to reduce the power consumption, thus improving the reliability and efficiency of the plasma ignition.

It is another object of the present invention is to provide a plasma ignition system in which a single high tension cable can be used both for supplying the spark discharge voltage and the plasma ignition current, thus making the wiring compact.

It is a further object of the present invention to provide a plasma ignition system in which it is possible to prevent electrical noise generated when the spark plug is discharged from being emitted therefrom.

To achieve the above-mentioned object, the plasma ignition system according to the present invention comprises a DC—DC converter for boosting a DC supply voltage to a high tension, a single ignition energy condenser for storing electric ignition energy, which is connected to the output of the converter, a plurality of switching units for applying the ignition energy to the plasma spark plugs at an appropriate ignition timing, and a plurality of boosting transformers.

Further, in this plasma ignition system according to the present invention, a single high tension cable is used to supply both the spark discharge voltage and the plasma ignition current in order to make the wiring compact.

Furthermore, in this plasma ignition system according to the present invention, the spark plug, boosting transformer, auxiliary condenser are shielded by a metal shield and a cylindrical noise-shorting condenser is provided in the metal shield, surrounding the input wire, in order to prevent electric noise generated when the spark plug is discharged.

BRIEF DESCRIPTION OF THE DRAWINGS

The features and advantages of the plasma ignition system according to the present invention will be more clearly appreciated from the following description taken in conjunction with the accompanying drawings in which like reference numerals designate corresponding elements and in which.

DETAILED DESCRIPTION OF THE PREFERRED EMBODIMENTS

To facilitate understanding of the present invention, a brief reference will be made to a prior-art plasma ignition system referring to FIGS. 1 and 2, and more specifically to FIG. 2.

Figure 1:
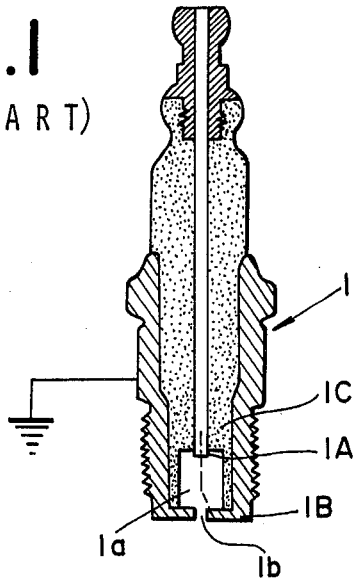
FIG.1 (PRIOR ART)
FIG. 1 is a longitudinal cross-sectional view of a plasma spark plug used with a plasma ignition system.

FIG. 1 shows a typical plasma spark plug 1 used with a prior-art plasma ignition system. In this plug, the gap between a central electrode 1A and a side electrode 1B is surrounded by an electrically insulating material 1*c* such as ceramic so as to form a small discharge space 1*a*. FIG. 2 shows a circuit diagram of a prior-art plasma ignition system in which the above-mentioned plasma spark plugs 1 are used. In this circuit, the current flowing from a battery 3 to the primary winding of an ignition coil 4 is turned on or off by a contact point 2 which is actuated by the crankshaft revolution to generate a high tension pulse signal with a maximum voltage of from −20 to −30 KV in the secondary winding of the ignition coil 4. The high tension pulse is sent to a distributer 6 through a diode 5 to prevent the plasma energy from being lost, and next is supplied, in firing order, to the spark plugs 1 arranged in the combustion chambers of the respective cylinders through respective high-tension cables 7 which each include a resistance. The spark plug 1 to which a high tension pulse is applied generates a spark between the central electrode 1A and the side electrode 1B, and subsequently a high energy electric charge (several Joules) of a relatively low voltage (from −1 to −2 KV) is passed between the electrodes for a short period of time (several hundreds of microseconds) from a plasma ignition power supply unit 8 in order to produce a plasma within the discharge space 1*a*. Therefore, it is possible to ignite the mixture surely and to stabilize the combustion performance by injecting the plasma from a jet hole 1*b* in the spark plug 1 into the combustion chamber. In this figure, the reference numeral 9 denotes diodes protecting the plasma ignition power supply unit 8.

Figure 2:
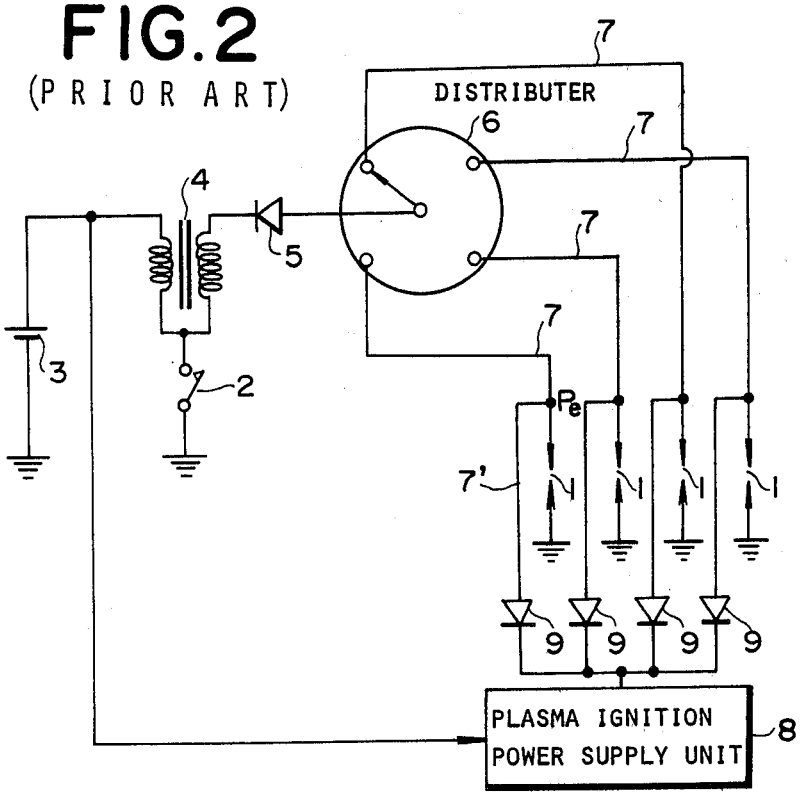
FIG.2 (PRIOR ART)
FIG. 2 is a schematic block diagram of a typical prior-art plasma ignition system.

In the prior-art plasma ignition system, however, as depicted in FIG. 2, since the output voltage from the plasma ignition power supply unit 8 is simultaneously applied to all the spark plugs 1 in the cylinders, when the insulation between the electrodes of the spark plug 1 breaks down owing to the influence of humidity changes in the mixture during the intake stroke or of carbon adhering to the spark plug 1, an unwanted discharge can be generated between the electrodes of the spark plug 1 by the voltage of the power supply unit 8 at times other than the desired ignition times, thus resulting in a problem with irregular discharge such that discharge is generated in the spark plug 1 other than at the predetermined ignition times.

Further, a large amount of power is consumed when the plasma ignition current is passed through the high voltage resistant diodes 9, amounting to about half of the total discharge power.

Furthermore, since high tension cables 7′ having a resistance of several tens of ohms or less connect the terminals of each spark plug 1 to the power supply unit 8 through the high voltage resistant diodes 9, when the spark plug 1 to which a high tension ignition pulse is applied from the ignition coil 4 begins to discharge, an impulsive current (several tens of amperes in peak value and several nano-seconds in pulse width) flowing around the spark plug 1 propagates to the high tension cables 7′, thus resulting in another problem such that strong wide-band electrical noise is emitted from the high tension cables 7′ in the range from several tens of MHz to several hundreds of MHz.

Figure 3:
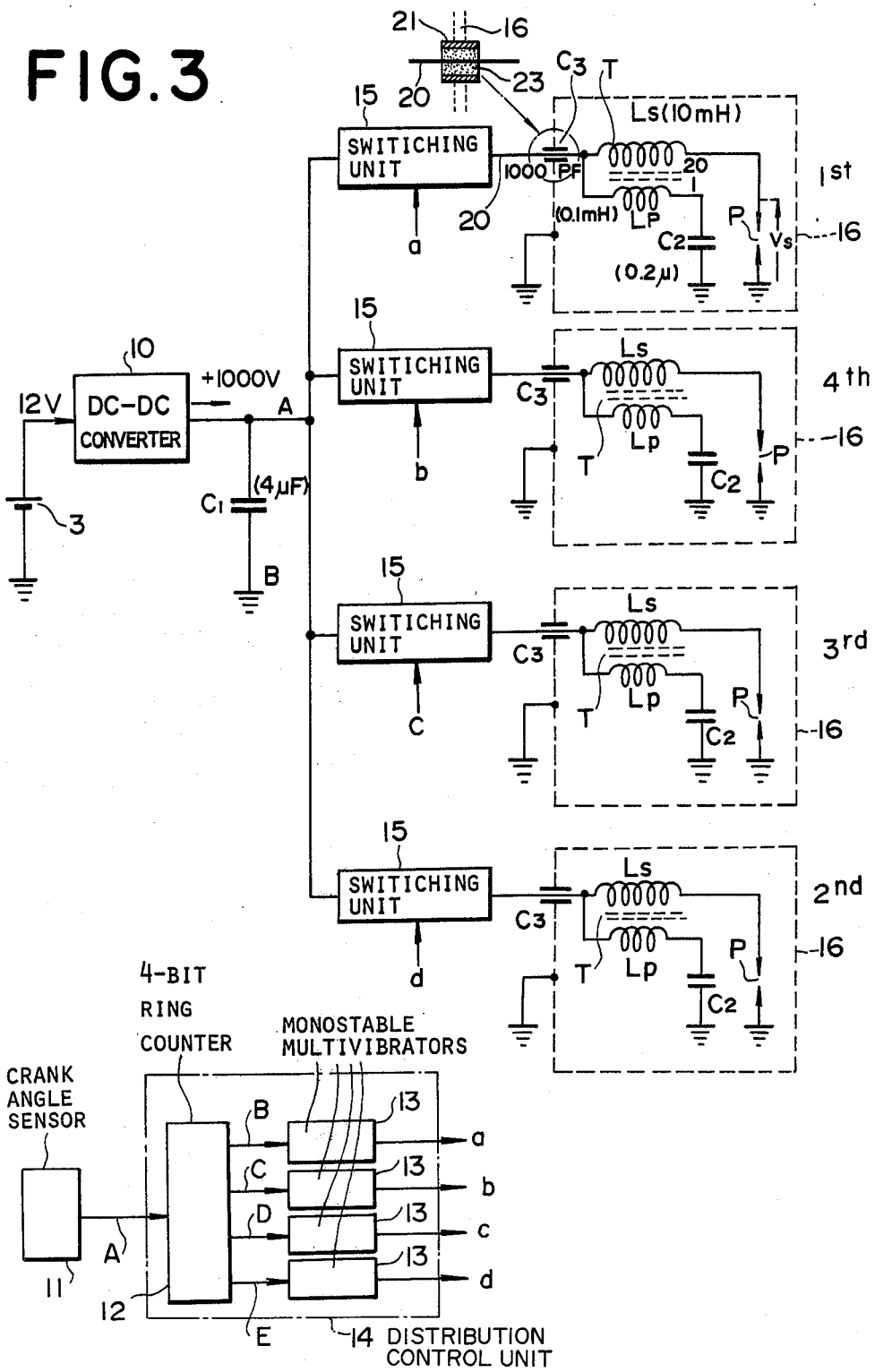
FIG. 3 is a schematic block diagram of a preferred embodiment of the plasma ignition system according to the present invention.

In view of the above description, reference is now made to FIGS. 3–13, and more specifically to FIG. 3.

In the plasma ignition system according to the present invention, a single condenser to store the ignition energy is provided for a plurality of cylinders; part of the current discharged from the condenser is passed through the primary coil of each boosting transformer in turn; the high tension generated from the secondary coil thereof is supplied to the respective spark plug in order to perform the spark discharge therein; the remaining discharge current is supplied to the spark plug later to perform the plasma ignition.

With reference to the attached drawings, there is explained a preferred embodiment of the plasma ignition system according to the present invention.

In FIG. 3 in which the configuration of the whole system is illustrated, an ignition-energy charging condenser $C_1$ (about 4 μF in capacity) and a plurality of switching units 15 each connected in series with a small-capacitance cylindrical noise-shorting condenser $C_3$ (about 1000 pF in capacity), the secondary coil Ls of a boosting transformer T and the central electrode of a spark plug P are connected in parallel to the output terminal Vo of a common DC-DC converter 10 able to boost a DC battery voltage of 12 V to a DC voltage of 1000 V.

The switching units 15 are connected to and controlled by the output terminals of a distribution control unit 14 made up of 4-bit ring counters 12A and monostable multivibrators 13, independently, so that the switching units are each turned on when the respective signals a-d are inputted thereto from the respective output terminals of the distribution control unit 14 at the respective predetermined ignition times.

The primary coils Lp of the boosting transformers T are each grounded through auxiliary condensers $C_2$ smaller in capacity (about 0.2 μF) than the ignition energy charging condenser $C_1$. In this embodiment, each system of spark plug P, boosting transformer T, and auxiliary condenser $C_2$ is shielded by a metal casing 16, and the respective cylindrical noise-shorting condenser $C_3$ is provided in the metal casing, with the grounded wall of the cylindrical condenser $C_3$ in contact with the wall of the metal casing 16.

In the cylindrical noise-shorting condenser $C_3$, as illustrated by an enlarged fragmentary view in FIG. 3, a wire 20 is passed through the central hole thereof and the cylindrical metal housing 21 thereof is fixed to a grounded metal shield 16 with insulation 23 disposed therebetween. Therefore, electrical noise in the wire 20 can be effectively shorted to the metal casing 16, that is, to the ground through the insulation 23, so that it is possible to prevent noise from being emitted therefrom.

Now follows an explanation of the operations of the plasma ignition system thus constructed.

A high voltage of Vo (e.g. 1000 V) outputted from the DC-DC converter 10 is directly applied to the condenser $C_1$ to charge the condenser $C_1$ with a high ignition energy (2 Joule).

Figure 4:
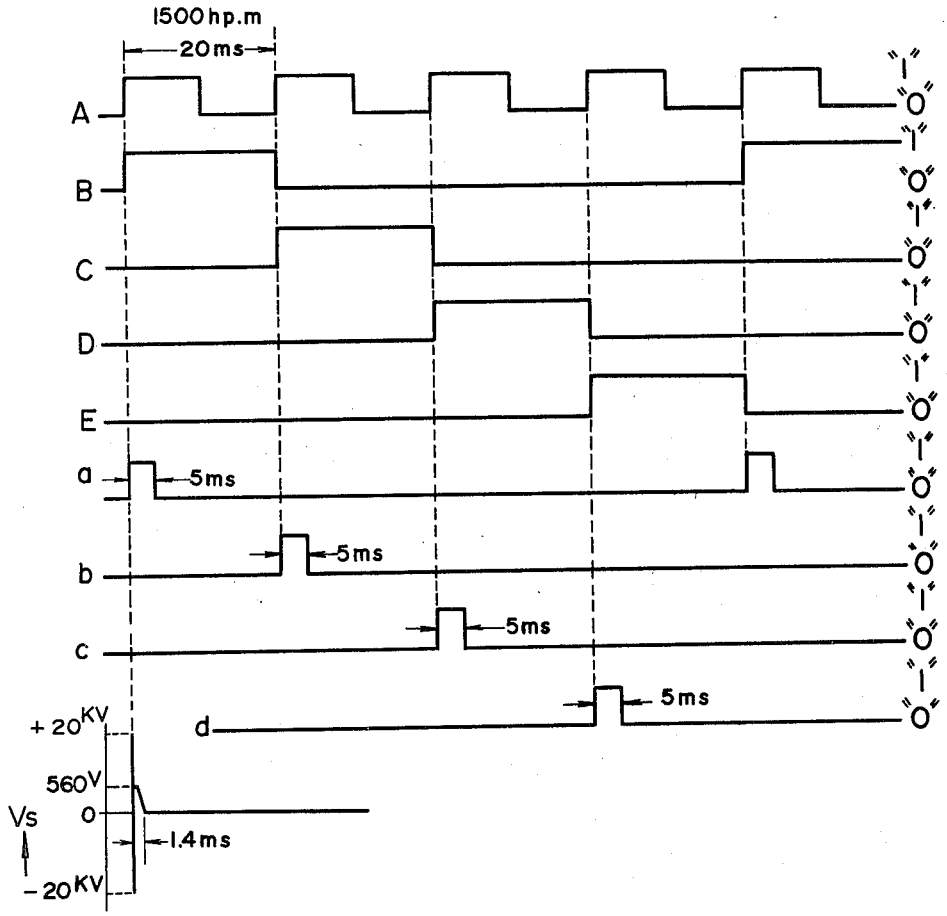
FIG. 4 is waveform representations showing ignition signal pulses generated at various points of the plasma ignition system shown in FIG. 3.

When the signal output from the crank-shaft angle sensor 11 which generates a pulse signal twice every crankshaft revolution (in a four-cylinder engine) in synchronization with the crankshaft revolution is inputted to the 4-bit ring counter 12 of the distribution control unit 14, the ring counter 12 generates four HIGH-level pulse signals of width 0.5 ms in firing order in accordance with the predetermined ignition timing, as shown by the pulse signals of B–E of FIG. 4. These pulses are inputted to the respective monostable multivibrators 13 in order to output the respective ignition pulse signals of a–d from the respective output terminals to the respective switching units 15.

When an HIGH-level ignition pulse signal is inputted to a switching unit 15, the switching unit 15 is turned on to discharge the ignition energy stored in the condenser $C_1$. At this moment, since the potential at the terminal A drops abruptly from $V_o$ to zero, the difference in potential $V_{AB}$ between terminals A and B of the condenser $C_1$ changes abruptly from zero to $-V_o$ due to the influence of the inductance of the primary coil $L_p$ of the boosting transformer.

Thus, a high voltage of $-V_o$ is applied to the respective boosting transformer T through the center of the cylindrical condenser $C_3$. Since a current is passed from the condenser $C_1$ to the condenser $C_2$ which is smaller in capacity than $C_1$ through the primary coil Lp, a high-frequency voltage with the maximum value of about $\pm V_o$ is generated between the terminals of the primary coil Lp.

If the winding ratio of the primary coil Lp to the secondary coil Ls is 1:N (e.g. 20), a high frequency voltage of about $\pm NV_o$ (e.g. $\pm$20 KV) is generated across the secondary coil Ls, since the voltage of the secondary coil is boosted so as to be N-times greater than that of the primary coil, so that discharge occurs between the central electrode and the side electrode of the spark plug P.

Thus, once a discharge occurs within the spark plug P, the space between the electrodes becomes conductive with a certain discharge resistance and therefore a part of the high energy (about 2 Joule) stored in the condenser $C_1$ is subsequently applied between the electrodes of the spark plug P for a short period of time through the secondary coil Ls (in this case the peak value of the current is kept below several tens of amperes).

When this high energy electrical charge is supplied, a plasma is produced within the discharge space of the spark plug P, so that the mixture is ignited perfectly. Further, in this embodiment, the switching units 11 are turned on by the HIGH-level ignition pulse signals a–d output from the distribution control unit 14 in order to supply high energy to the corresponding spark plugs P in the same order from a to d, so that the cylinders are fired in the order of $1^{st}$, $4^{th}$, $3^{rd}$ and $2^{nd}$ cylinder. The voltage Vs between the electrodes of each spark plugs P changes as shown in FIG. 4.

In the plasma ignition system thus constructed, since a plasma ignition current is supplied to the spark plug P only at the time of ignition and since it is possible to prevent high voltage from being applied thereto during the energization of the other spark plugs, it is possible to reliably avoid irregular discharge such that unwanted ignition occurs within the cylinders during the other strokes.

Further, since there is no need to provide a high voltage resistant diode on the discharge line from the condenser $C_1$ to the gap between the electrodes of the spark plug P, it is possible to prevent the consumption of ignition energy in the diode, thus markedly improving the power supply efficiency of the ignition system.

Further, since it is possible to use a single high tension cable to supply the spark discharge voltage to the spark plug P at the start of ignition and for supplying the plasma ignition current during ignition, it is possible to make the wiring compact.

Furthermore, since the spark plug P, boosting transformer T, and auxiliary condenser $C_2$ are shielded by the metal casing 16 as shown in the figure and since the cylindrical noise-shorting condenser $C_3$ is fitted to the input terminal, it is possible to prevent electrical noise generated by impulsive currents flowing near the spark plug P at the start of the discharge from leaking out.

Next, a preferred embodiment of the switching unit 11 is described below.

Figure 5:
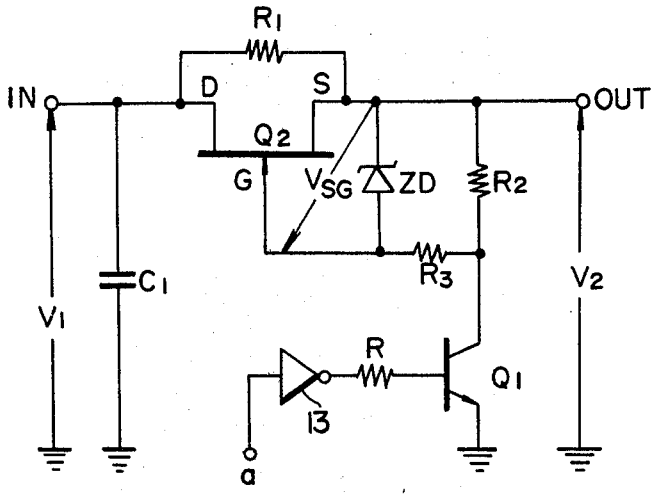
FIG. 5 is a circuit diagram of a sample preferred embodiment of the switching unit used for the plasma ignition system according to the present invention.

FIG. 5 shows a circuit configuration of a preferred embodiment of the switching unit 15. In this embodiment, although an electrostatic induction type transistor (a kind of high-voltage resistant FETs) is used as the semiconductor switching element, it is of course possible to use a thyristor (silicon controlled rectifier) high voltage resistant transistor, etc. for the switching element. In the ordinary state, since the ignition pulse signal a is LOW level and thus the output of the inverter 13 is HIGH level, the transistor $Q_1$ is kept turned on. If the input voltage is $V_1$ (1000 V), the output voltage $V_2$ is modified by the resistors $R_1$ and $R_2$; that is, the voltage $V_2$ can be given as follows:

$$V_2 \neq \frac{R_2}{R_1 + R_2} \cdot V_1$$

In this embodiment, since the Zener voltage $V_z$ of the Zener diode ZD is selected so that $$V_z > \frac{R_2}{R_1 + R_2} \cdot V_1$$

no current is passed through the Zener diode ZD, and the voltage $V_{SG}$ between the source S and the gate G of the electrostatic induction type transistor $Q_2$ is $$V_{SG} = -\frac{R_2}{R_1 + R_2} \cdot V_1$$

so that the voltage $V_{SG}$ is kept lower than the pinch-off voltage to cut off the drain current flowing between the drain D and the source S of the transistor $Q_2$.

Therefore, the transistor $Q_2$ is off, that is, the switching unit is off.

Next, if the ignition pulse signal changes to HIGH level and thus the output of the inverter 13 is LOW level the transistor $Q_1$ is off. Accordingly, since the voltage $V_{SG}$ changes from $$-\frac{R_2}{R_1 + R_2} \cdot V_1$$

to zero, the transistor $Q_2$ is turned on, so that the output voltage $V_2$ of the transistor $Q_1$ becomes $V_1$. In this case, the resistance between the drain and the source $r_{on}$ is about three ohms.

When the ignition pulse signal a returns to LOW level again, the transistor $Q_1$ is turned on. At this moment, the voltage across the resistor $R_2$ changes momentarily to $V_1$ because the transistor $Q_2$ is on; however, since a current flows through the Zener diode which has already been turned on, the voltage $V_{SG}$ between the source and the drain is kept at the Zener voltage of $-V_z$, without increasing beyond the maximum rated voltage of $V_{SGO}$. In this case, since the following relationship:

$$V_{SG} = -V_z \leqq \frac{-R_1}{R_1 + R_2} \cdot V_1 < V_P$$

is satisfied, the voltage $V_{SG}$ is kept below the pinch off voltage $V_P$ and thus the transistor $Q_2$ is turned off again, the current flowing between the drain and the source is returned to the off-state.

Figure 6:
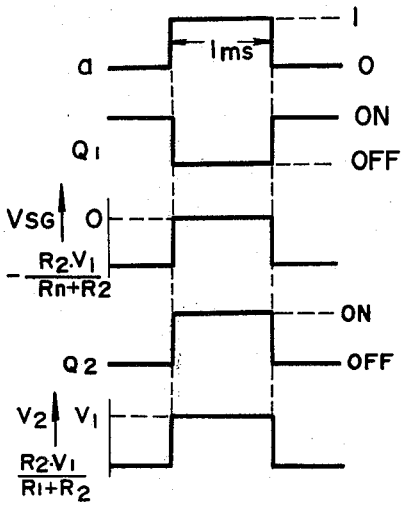
FIG. 6 is waveform representations showing ignition signal pulses generated at various points of the circuit of FIG. 5.

FIG. 6 shows the voltage waveforms at the respective points of the switching circuit shown in FIG. 5.

Next, follows a theoretical analysis of the transient phenomena of the ignition circuit used with the plasma ignition system according to the present invention, in order to examine the variation of discharge voltage $V_s$ generated between the electrodes of the ignition plug.

Figure 7A:
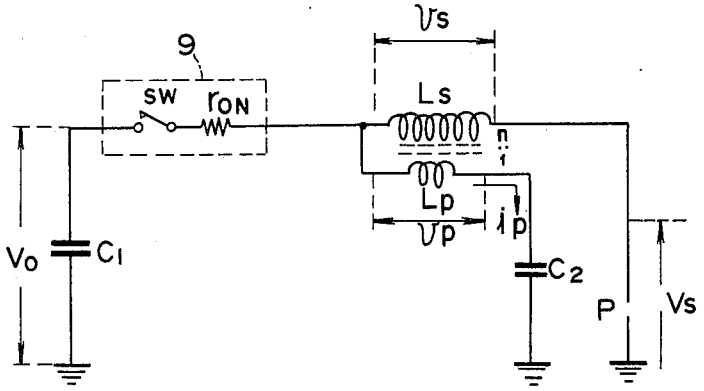
FIG. 7(A) is an equivalent circuit diagram of the cylinder ignition circuit used for the plasma ignition system according to the present invention.

If the symbol $r_{on}$ denotes the internal resistance of the switching unit 15, it is possible to illustrate the respective ignition circuits for the respective cylinders as an equivalent circuit shown in FIG. 7(A). In this equivalent circuit, the condenser $C_3$ is omitted, since the capacitance of the condenser $C_3$ is as small as 1000 pF as compared with that of the condenser $C_2$ of 0.2 $\mu$F and therefore exerts a very small influence upon the transient phenomena of the circuit.

Figure 7B:
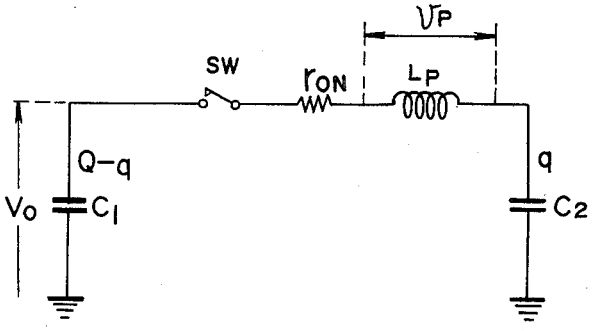
FIG. 7(B) is an equivalent circuit diagram including the primary coil of the boosting transformer shown in FIG. 7(A)

As well as the equivalent circuit of FIG. 7(A), it is possible to show the other equivalent circuit including only the primary coil $L_P$ as in FIG. 7(B).

If the symbol $V_o$ denotes the voltage across the condenser $C_1$ immediately before the switch SW is turned on, the electric charge Q stored in the condenser $C_1$ can be given as $$Q = C_1 V_o \tag{1}$$

Now, if the symbol q denotes the electric charge stored in the condenser $C_2$ t sec after the switch has been turned on, since the electric charge on the condenser $C_1$ is $Q_1 - q$, the following equation can be given:

$$L_P \frac{d^2q}{dt^2} + r_{on}\frac{dq}{dt} + \frac{q}{C_2} = \frac{Q-q}{C_1} \tag{2A}$$

When rewritten with the equation (1) substituted, the equation (2 A) is as follows:

$$L_P \frac{d^2q}{dt^2} + r_{on}\frac{dq}{dt} + \left(\frac{1}{C_1} + \frac{1}{C_2}\right) q = \frac{Q}{C_1} = V_o \tag{2B}$$

if $C_1 = 4$ $\mu$F, and $C_2 = 0.2$ $\mu$F, the relationship of $(1/C_1) << (1/C_2)$ is satisfied, and therefore the equation (2B) can be simplified as follows:

$$L_P \frac{d^2q}{dt^2} + r_{on}\frac{dq}{dt} + \frac{q}{C_2} = V_o \tag{2C}$$

Figure 8:
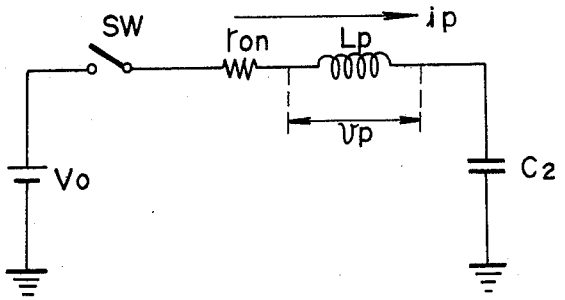
FIG. 8 is another equivalent circuit diagram of the circuit shown in FIG. 7(B)

Depending upon the equation (2C), it is possible to rewrite the equivalent circuit of FIG. 7(B) to the one of FIG. 8.

A transient phenomena when the switch is turned from off to on in the equivalent circuit of FIG. 8 is analyzed hereinbelow. On the basis of the ordinary vibration theory of a circuit including an inductance, a condenser, and a resistor in series, the following analysis is made.

$$\text{If } r_{on} = 3 \text{ ohms, } L_P = 100\ \mu\text{H, and } C_2 = 0.2\ \mu\text{F,} \tag{3}$$

the following relationship can be satisfied:

$$r_{on} < 2\sqrt{\frac{L_P}{C_2}}$$

The current $i_p$ t sec after the switch SW has been turned on can be obtained from the theoretical expression of this vibration circuit as follows:

$$i_p = \frac{V_o}{\sqrt{\frac{L_P}{C_2} - \left(\frac{r_{on}}{2}\right)^2}} \epsilon^{-\alpha \cdot t} \cdot \sin \beta \cdot t \tag{4}$$

By substituting the conditions of (3) into the above equation (4), $$i_p = 4.5 \times 10^{-2}\ V_o \cdot \epsilon^{-\alpha_1 t} \sin \beta_1 t \tag{5}$$

where $$\alpha_1 = \frac{r_{on}}{2L_P} = 1.5 \times 10^4$$

$$\beta_1 = \sqrt{\frac{1}{L_P C_2} - \left(\frac{r_{on}}{2L_P}\right)^2} = 2.3 \times 10^5$$

Therefore, the period of the vibration is $$T_{P1} = 2\pi/\beta_1 = 27\ \mu s$$

Further, the time $t_{p1}$ from when the switch is turned on to when the current $i_p$ reaches the first peak value $i_{mo}$ is given from another theoretical expression of this circuit as follows:

$$t_{p1} = \theta_1/\beta_1, \text{ where } \tan \theta_1 = \beta_1/\alpha_1$$

$$\theta_1 = \tan^{-1}\left(\frac{2.3 \times 10^5}{1.5 \times 10^4}\right) = 0.48\pi = 1.5$$

Therefore, $t_{p1} = 6.5$ $\mu$s

Further, $$i_{mo} = V_o \sqrt{\frac{C_2}{L_P}}\, \epsilon^{-\frac{\alpha 1}{\beta 1}\theta 1} = 4.1 \times 10^{-2} V_o (A)$$

On the other hand, if the symbol $V_p$ denotes the voltage across the coil $L_P$, $$v_P = L_P \cdot \frac{d\, ip}{dt} = \sqrt{\frac{L_P}{C_2}} \cdot \frac{-V_o}{\sqrt{\frac{L_P}{C_2} - \left(\frac{r_{on}}{2}\right)^2}} \cdot \epsilon^{-\alpha 1 t} \sin(\beta_1 t - \theta_1) \quad (6)$$

Figure 9:
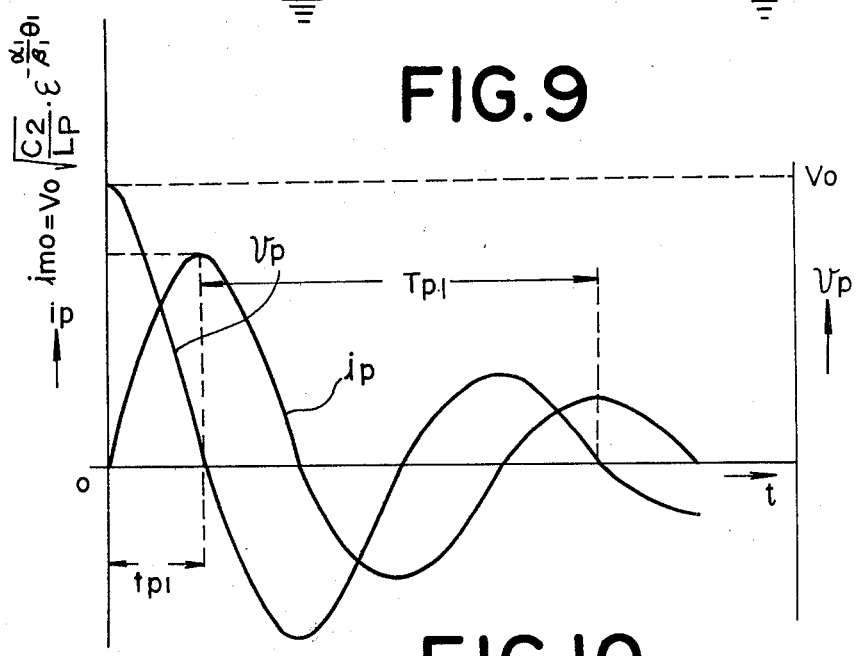
FIG. 9 is a graphical representation showing the transient state of the voltage $V_P$ and the current ip developed across the primary coil of the boosting transformer after the discharge has been performed in the spark plug.

FIG. 9 shows the current ip and the voltage $V_P$ of the high frequency damped vibration expressed by the equations (4) and (6).

Here, the half-amplitude period T during which the amplitude of the vibration voltage $V_P$ decreases to the half of its initial value can be obtained as follows: by substituting $\alpha_1 = 1.5 \times 10^4$ into the relationship $\epsilon^{-\alpha 1 t} = 0.5$:

$$\tau \approx 0.46 \times 10^{-4}\ s = 46\ \mu s$$

Figure 10:
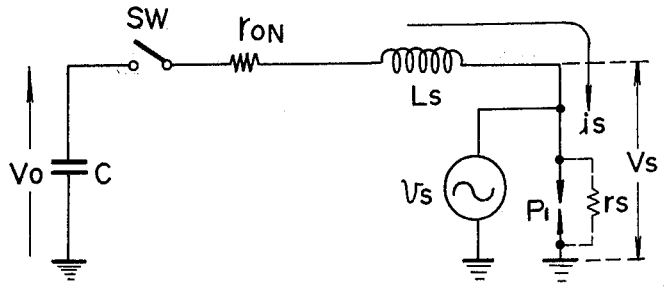
FIG. 10 is an equivalent circuit diagram including the secondary coil of the boosting transformer shown in FIG. 7(A)

On the other hand, FIG. 10 shows an equivalent circuit to that shown in FIG. 7(A) including the secondary coil $L_s$ of the boosting transformer T.

Figure 11:
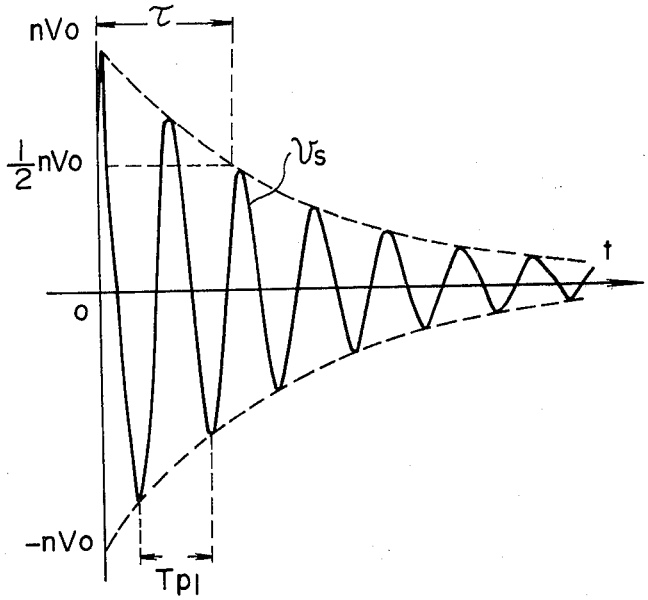
FIG. 11 is a graphical representation showing the transient state of the voltage $v_s$ developed across the secondary coil of the boosting transformer after the discharge has been performed in the spark plug.

If n is the winding ratio of the boosting transformer T, the terminal voltage $v_s$ across the secondary coil $L_s$ can be expressed as $v_{s=nvp}$, which is illustrated in FIG. 11 as a high-frequency damped vibration. For instance, when the winding ratio n is 20 and the maximum value $V_o$ of $v_p$ is 1000 V, the maximum value of $v_s$ reaches as much as 20 KV, allowing reliable spark discharge to be generated under every engine operating condition.

Now, the current $i_s$ t seconds after the switch SW has been turned on can be obtained in the manner described below.

Since the discharge resistance is $$r_s \geqq r_{on}$$

when $R = r_s = 100$ ohm, $L_s = 40$ mH, $C_1 = 4\ \mu F$, the relationship $R < 2\ (L/C)$ is satisfied.

In the theoretical expression, if $i = -i_s$, since $Q = C_1 V_o$, $$i_s = \frac{2C_1 V_o}{\sqrt{4L_s C_1 - (r_s C_1)^2}}\, \epsilon^{-\alpha 2 t} \cdot \sin \beta_2 t \quad (7)$$

since, $$\alpha_2 = r_s / 2L_s = 1250$$

$$\beta_2 = \sqrt{\frac{1}{L_s C_1} - \frac{r_s^2}{2L_s}} \neq 2170$$

If $i_{mo} = I_{P2}$, the peak value $I_{P2}$ of $i_s$ after $t_{p2}$ is given as:

$$I_{P2} = \frac{C_1 V_o}{\sqrt{L_s C_1}}\, \epsilon^{-\frac{\alpha 2}{\beta 2}\theta 2} \quad (8)$$

where $$\tan \theta_2 = \frac{\beta_2}{\alpha_2} = 1.74 \qquad \theta_2 = 1.0$$

Therefore, $$\frac{\alpha_2}{\beta_2}\theta_2 \neq 0.58$$

By substituting this value into equation (8), $$I_{P2} = 5.6 \times 10^{-3 \times V0} \text{ and}$$

$$t_{p2} = \frac{\theta_2}{\beta_2} = 0.46\ (ms)$$

Figure 12:
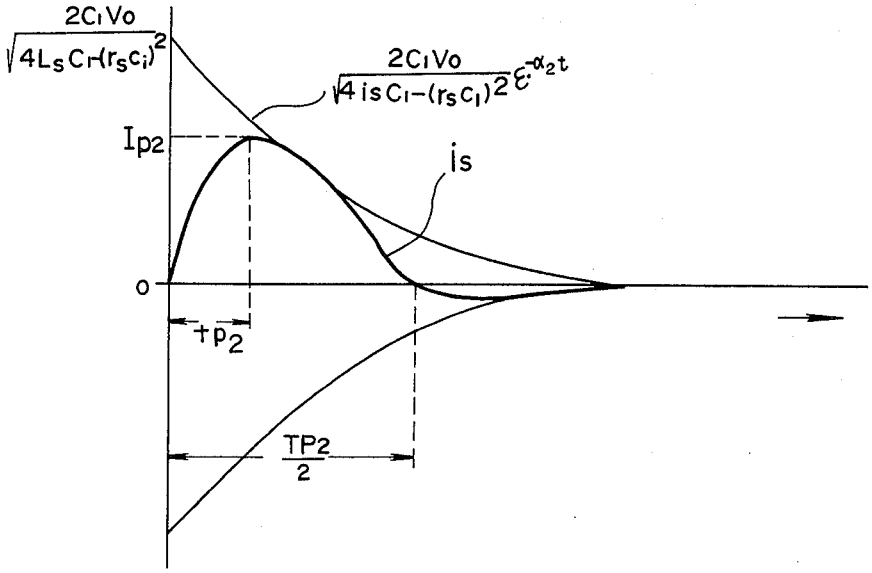
FIG. 12 is a graphical representation showing the transient state of the current $i_s$ flowing through the electrodes of the spark plug.

Therefore, the current $i_s$ can be expressed as a pulse signal shown in FIG. 12, and a high energy of about 2 Joule charged in the condenser $C_1$ during a short period of time of $T_{p2}/2 = (\pi/\beta_2) \approx 1.4$ ms (where $T_{P2}$ denotes the period of $i_s$) is supplied to the spark plug.

At this moment, since the $v_s$ and the discharge voltage $i_s \cdot r_s$ when $i_s$ is being supplied are superinposed, the terminal voltage $V_s$ across the terminals of the spark plug P can be given by the following expression.

$$V_s = v_s + i_s \cdot r_s$$

Figure 13:
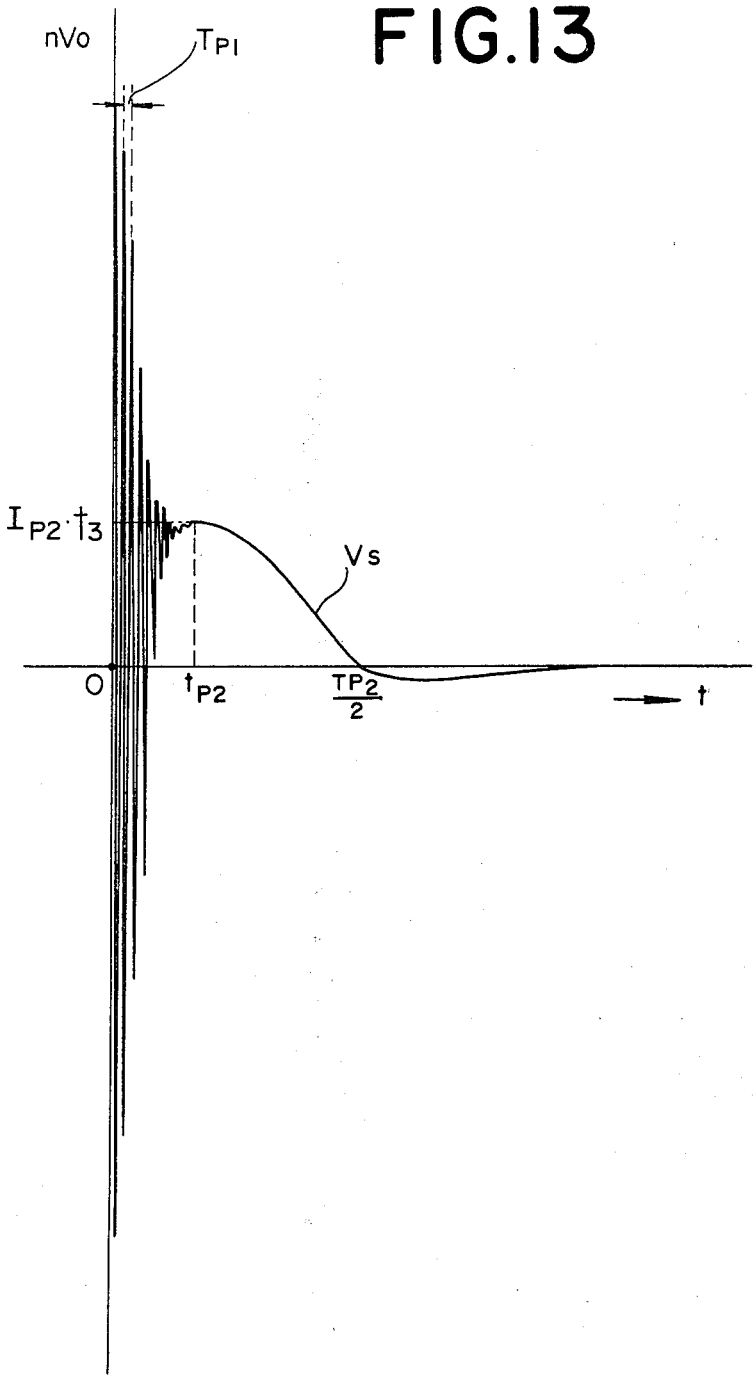
FIG. 13 shows the waveform of voltage $V_s$.

FIG. 13 shows the waveform of the voltage $V_s$.

As described hereinabove since the plasma ignition system according to the present invention is so constructed that the condenser to store high ignition energy for each cylinder are independently connected to the output terminal of the DC—DC converter in order to perform plasma ignition by applying the current discharged from the condenser to the space between the electrodes of the spark plug through the relevant boosting transformer when the relevant switching unit is turned on at the predetermined ignition times, it is possible to prevent irregular discharge between the electrodes, eliminate the need of high voltage resistant diodes in the discharge circuit, reduce the power consumption, and thus improve markedly the efficiency of the power supply for the ignition system.

Further, since the voltage across the condenser storing ignition energy can be made smaller according to the winding ratio of the boosting transformer, the durability of the switching unit can be improved, and since a single high tension cable can be used for supplying the spark discharge voltage and plasma ignition current, it is possible to make the wiring compact.

Furthermore, since each spark plug, boosting transformer, and auxiliary condenser are so arranged as to be covered by a metal shield, and a cylindrical noise-shorting condenser is provided in the casing around the wire, it is possible to prevent electrical noise generated when the spark plug is discharged from leaking out.

It will be understood by those skilled in the art that the foregoing description is in terms of preferred embodiments of the present invention wherein various changes and modifications may be made without departing from the spirit and scope of the invention, as set forth in the appended claims.

10 . . . DC-DC converter
11 . . . Crankshaft angle sensor
12 . . . Ring counter
13 . . . Monostable multivibrator
14 . . . Distribution control unit
15 . . . Switching unit
16 . . . Metal shield casing
P . . . Plasma spark plug
$C_1$ . . . Ignition energy condenser
$C_2$ . . . Auxiliary condenser
$C_3$ . . . cylindrical noise-shorting condenser
T . . . Boosting transformer

What is claimed is:

1. A plasma ignition system for an internal combustion engine which comprises:

(a) a plurality of plasma spark plugs, one terminal of each being grounded;

(b) a DC—DC converter for boosting a DC supply voltage to a high tension;

(c) an ignition energy condenser for storing electric ignition energy, said ignition energy condenser being connected to the output of said DC—DC converter;

(d) a plurality of switching units each for applying the ignition energy charged in said ignition energy condenser to the respective plasma spark plug with an appropriate ignition timing, said switching units being connected to said ignition energy condenser;

(e) a plurality of boosting transformers each for boosting the voltage across said ignition energy condenser to a still higher voltage, the common terminal of the respective primary and secondary coils being connected to said respective switching units, the other terminal of the respective secondary coil being connected to the terminal of said respective plasma spark plug other than the grounded terminal; and (f) a plurality of auxiliary condensers each for connecting the other terminal of the primary coil of said respective boosting transformer to the ground, said auxiliary condensers forming an oscillation circuit together with the primary coil of said boosting transformer, whereby when said switching unit is turned on in order to discharge a current from said ignition energy condenser to said auxiliary condenser through the primary coil, a high tension is generated at the secondary coil of said boosting transformer so as to generate a spark between the electrodes of said plasma spark plug and subsequently a large current is passed through the electrodes of said plasma spark plug by the remaining plasma ignition energy stored in said ignition energy condenser so as to produce a plasma therebetween for completing the plasma ignition.

2. A plasma ignition system for an internal combustion engine as set forth in claim 1, which further comprises:

(a) a plurality of metal shield casings each for housing one each of said plurality of plasma spark plugs, boosting transformers, and auxiliary condensers together therewithin, said metal shields being grounded; and (b) a plurality of cylindrical noise-shorting condensers each for shorting out high frequency noise generated in the wire connecting each said switching unit and said boosting transformer to the ground, said cylindrical condenser being disposed in a position passing through said metal shield casing, the wire connecting the switching unit and transformer being passed through said cylindrical noise-shorting condenser, whereby electrical noise generated when plasma ignition is performed between the electrodes of said spark plug can be shielded.

3. A plasma ignition system for an internal combustion engine as set forth in claim 1, which further comprises a timing unit for outputting appropriate timing pulse signals to said plurality of switching units in order to apply ignition energy to said spark plugs, which comprises:

(a) a crankshaft angle sensor for outputting a pulse signal in synchronization with the crankshaft revolution; and (b) a multi-bit ring counter for outputting a plurality of independent pulse signals in order in response to the pulse signal sent from said crankshaft angle sensor in order to apply appropriate ignition timing signals to said respective switching units.

4. A plasma ignition system for an internal combustion engine as set forth in claim 3 which further comprises a plurality of monostable multivibrators each for outputting the respective pulse ignition timing signals with an appropriate constant pulse width to said respective switching units in response to the signal from said crankshaft angle sensor, said monostable multivibrators being connected between the respective outputs of said ring counter and said respective switching units.

5. A plasma ignition system for an internal combustion engine as set forth in claim 1, wherein one of said plurality of switching units includes a high voltage resistant semiconductor switching element.

6. A plasma ignition system for an internal combustion engine as set forth in claim 5, wherein said high voltage resistant semiconductor is a thyristor.

7. A plasma ignition system for an internal combustion engine as set forth in claim 5, wherein said high voltage resistant semiconductor is a high voltage resistant transistor.

8. A plasma ignition system for an internal combustion engine as set forth in claim 5, wherein said high voltage resistant semiconductor is a field effect transistor.

9. A plasma ignition system for an internal combustion engine as set forth in claim 8, wherein said switching unit including a field effect transistor comprises:

(a) a first resistor;

(b) a second resistor;

(c) an inverter for inverting an appropriate ignition timing signal sent from said distribution control unit;

(d) a high-voltage resistant transistor turned on or off in response to the signal from said inverter, the base thereof being connected to the output of said inverter, the emitter thereof being grounded;

(e) a high-voltage resistant electrostatic induction type field effect transistor for discharging the ignition energy charged in said ignition energy condenser to said boosting transformer, the drain thereof being connected to said condenser, the source thereof being connected to said boosting transformer and to the collector of said high-voltage resistant transistor through said second resistor, said first resistor being connected between the drain and the source thereof, the gate thereof being connected to the collector of said transistor, whereby when an ignition timing signal is applied to said inverter to turn off said high-voltage resistant transistor, said electrostatic induction type transistor is turned on since the voltage between the source and the gate thereof changes to zero volts, and when no ignition timing signal is applied to said inverter to turn on said transistor, said electrostatic induction type transistor is turned off since the voltage at the gate thereof drops to a minus voltage as compared with the voltage at the source thereof.

10. A plasma ignition system for an internal combustion engine as set forth in claim 1, wherein said plurality of auxiliary condensers are smaller in capacity than said ignition energy condenser.

11. A plasma ignition system for an internal combustion engine as set forth in any of claims 1 and 2, wherein the number of each of said plasma spark plugs, switching units, boosting transformers, auxiliary condensers, metal shield casings, cylindrical noise-shorting condensers, are the same as that of the cylinders of the internal combustion engine.

12. A plasma ignition system for an internal combustion engine as set forth in any of claims 3 and 4, wherein the number of each of said multi-bit ring counters, and monostable multivibrators is the same as that of the cylinders of the internal combustion engine.

13. A method of plasma-igniting the fuel in the cylinders of an internal combustion engine, which comprises the steps of:

(a) boosting a supply voltage to a high tension;

(b) storing the boosted high-tension ignition energy in a condenser;

(c) discharging part of the ignition energy stored in the condenser through one of a plurality of oscillation circuits including the primary coil of a boosting transformer and an auxiliary condenser, respectively, so as to generate a spark due to a still higher voltage across the secondary coil thereof at the appropriate ignition timing, so that the space between the electrodes of one of a plurality of spark plugs becomes conductive with a certain discharge resistance; and (d) discharging the remaining energy stored in the condenser, through the secondary coil of the boosting transformer, to the space between the electrodes of the spark plug so as to produce a plasma therebetween for igniting the mixture within the cylinder.

14. A method of plasma-igniting the fuel within the cylinders of an internal combustion engine as set forth in claim 13, wherein the high-tension ignition energy charged in said condenser is discharged in the appropriate order through the respective boosting transformers provided for the respective cylinders in accordance with the respective ignition timings.

15. A method of plasma-igniting the fuel within the cylinders of an internal combustion engine as set forth in claim 13, wherein the appropriate ignition timings are produced by detecting the predetermined revolution angles of a crankshaft.

16. A method of plasma-igniting the fuel within the cylinders of an internal combustion engine as set forth in claim 13, wherein the respective auxiliary condensers, and the respective spark plugs are covered by the respective metal casings with the casings being connected to the gound, and the respective wires connecting the boosting transformer to the switching unit are taken out through the respective cylindrical noise-shorting condensers provided in an appropriate portion of the metal sheild casings, so that electrical noise generated when plasma ignition is performed can be shielded.

* * * * *